United States Patent [19]

Fales

[11] 4,413,953

[45] Nov. 8, 1983

[54] TWO-STAGE HYDRAULIC PISTON PUMP

[75] Inventor: Douglas I. Fales, Burton, Mich.

[73] Assignee: General Motors Corporation, Detroit, Mich.

[21] Appl. No.: 332,369

[22] Filed: Dec. 21, 1981

[51] Int. Cl.[3] ..... F04B 3/00; F04B 17/04; F04B 39/10

[52] U.S. Cl. ..... 417/262; 417/417; 417/490

[58] Field of Search ..... 417/417, 262, 261, 259, 417/493, 495, 268, 490, 418, 254

[56] References Cited

U.S. PATENT DOCUMENTS

| | | | |
|---|---|---|---|
| 2,254,432 | 9/1941 | Lieberman | 417/417 |
| 2,582,535 | 1/1952 | Drouot | 417/493 |
| 2,634,805 | 4/1953 | Bills et al. | 417/417 X |
| 4,314,797 | 2/1982 | Gerwin | 417/418 X |

*Primary Examiner*—Richard E. Gluck
*Assistant Examiner*—Peter M. Cuomo
*Attorney, Agent, or Firm*—Donald F. Scherer

[57] ABSTRACT

A two-stage piston pump has serially arranged pump chambers each having an input passage and a delivery passage. The first stage has a larger displacement than the second stage such that complete filling of the second stage is attained. The piston of the first stage is reciprocated through the cooperation of a spring and a selectively energizable solenoid coil. The piston of the second stage is secured to and reciprocable with the first stage piston. The cylinder for the second stage has an overflow passage disposed to ensure that all the fluid discharged from the first stage prior to the second stage piston closing the overflow passage passes through the second stage cylinder.

4 Claims, 1 Drawing Figure

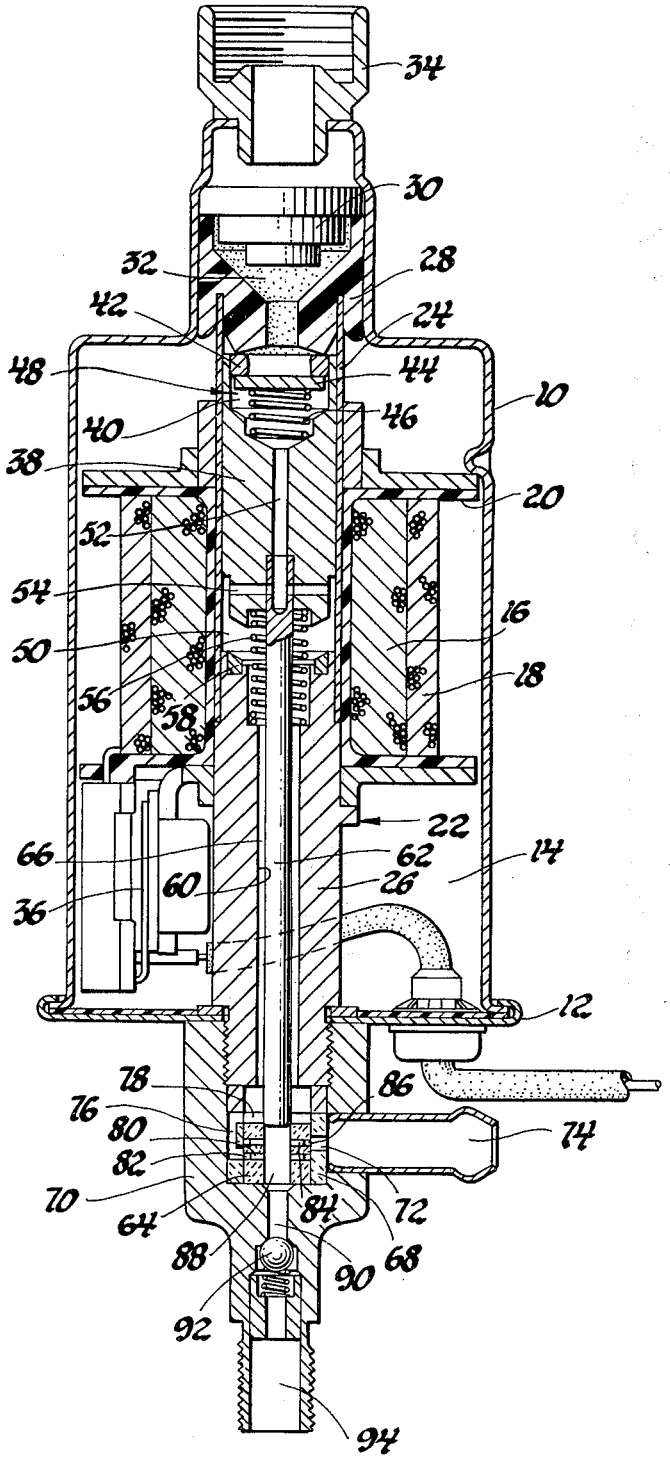
34
30
32
28
42
24
48
44
10
40
46
38
20
52
54
16
50
18
56
58
22
66
62
14
60
26
36
12
78
86
76
80
74
82
70
84
72
64
88
68
90
92
94

TWO-STAGE HYDRAULIC PISTON PUMP

This invention relates to solenoid operated hydraulic piston pumps and more particularly to such pumps having serially arranged stages.

It is an object of this invention to provide an improved two-stage hydraulic piston pump wherein the first stage has a larger displacement than the second stage.

It is another object of this invention to provide an improved two-stage solenoid hydraulic piston pump wherein the first stage discharges more fluid than the second stage can utilize and wherein a portion of the first stage discharge is directed through the second stage cylinder prior to the second stage piston being operable to discharge fluid.

A further object of this invention is to provide an improved two-stage solenoid operated hydraulic piston pump wherein the primary stage has a larger displacement than the secondary stage and where a portion of the primary stage discharge stroke occurs prior to the beginning of the discharge from the secondary stage.

A still further object of this invention is to provide an improved two-stage solenoid operated hydraulic piston pump wherein the primary stage includes an armature piston responsive to a solenoid coil and spring for reciprocation in a nonmagnetic portion of a cylinder assembly and wherein a nonmagnetic stop member prevents abutment of the armature piston with a magnetic portion of the cylinder assembly and also wherein the secondary stage includes a cylinder having an inlet passage and an overflow passage with the overflow passage being closed during the discharge stroke by the secondary piston prior to the closing of the intake passage.

These and other objects and advantages of the present invention will be more apparent from the following description and drawing which is a cross-sectional elevational view of a pump incorporating the present invention.

Referring to the drawing, there is seen a solenoid operated pump having a housing 10 and a housing end cap 12 secured together to form a cavity 14 in which is disposed a pair of solenoid coils 16 and 18 wound on a nonmagnetic spool 20 and surrounding a cylinder assembly 22. The cylinder assembly 22 includes a nonmagnetic cylinder portion 24 and a magnetic portion 26. The nonmagnetic portion 24 has secured at the upper end thereof a seal member 28 which is secured in the housing 10. Also secured in the housing 10 adjacent the seal 28 is an inlet valve 30 which cooperates with the seal 28 to form an inlet chamber 32. The inlet valve 30 is adapted to be connected to an external reservoir through an inlet port 34 which is secured to the housing 10. The solenoid coils 16 and 18 are adapted to be energized by a conventional power control circuit 36 which is a conventional structure and may be constructed in accordance with many well-known devices so as to provide sequential or cyclic energization and deenergization of the solenoid coils 16 and 18.

An armature piston 38 is made of magnetic material and slidably disposed in the nonmagnetic cylinder 24. The armature piston 38 has formed therein a valve chamber 40 in which is secured a valve seat 42 which cooperates with a plate member 44 and a spring member 46 to form a control valve, generally designated 48. The control valve 48 is in fluid communication through the seal member 28 with the inlet chamber 32. The valve chamber 40 is in fluid communication with a pump chamber 50 through an axial passage 52 and a radial passage 54, both of which passages are formed in the armature piston 38. A nonmagnetic return spring 56 is disposed between the magnetic portion 26 with cylinder assembly 22 and the armature piston 38 so as to urge the armature piston 38 upward as viewed in the drawing such that the valve seat 42 abuts the seal member 28. An annular nonmagnetic resilient member 58 is secured in the magnetic portion 26 so as to provide a nonmagnetic abutment surface for the armature piston 38. This nonmagnetic abutment surface prevents contact between the armature piston 38 and the magnetic portion 26 when the armature piston 38 moves downward under the influence of the magnetic field created by the solenoid coils 16 and 18. This permits the return spring 56 to move the armature piston 38 upwardly without having to expend a portion of the stored energy overcoming the magnetic attraction which might otherwise arise in the presence of contact between the armature piston 38 and magnetic portion 26.

The magnetic portion 26 has formed therein an axially extending passage 60 in which is disposed a secondary piston 62 which is secured to the armature piston 38 and has formed therein a portion of passages 52 and 54. The secondary piston 62 is of sufficient length to extend through the lower end of magnetic portion 26 and into the upper end of a nonmagnetic secondary cylinder 64. The axial passage 60 and secondary piston 62 cooperate to form an annular discharge passage 66 for the pump chamber 50.

The secondary cylinder 64 is disposed in an annular housing 68 which in turn is disposed in cylinder housing 70 which is threadably secured to the magnetic portion 26. The annular housing 68 has formed therein a return passage 72 which is in fluid communication with a return tube 74 and a flow passage 76 which is in fluid communication with the discharge passage 66 through a radial passage 78 formed in the upper end of the secondary cylinder 64. The secondary cylinder 64 has a radially disposed inlet passage 80 formed therein which includes an annular outer recess 82 in fluid communication with the flow passage 76. The secondary cylinder 64 also has formed therein a radial overflow passage 84 which has an outer annular recess 86 in fluid communication with the overflow passage 72. An axially extending opening or passage 88 is formed in the secondary cylinder 64 and cooperates with the secondary piston 62 to provide a second pumping stage.

The passage 88 is in fluid communication with an outlet passage 90 which is selectively closed by an outlet valve 92 which is in fluid communication with a discharge port 94 formed integrally with the cylinder housing 70.

In the position shown, assuming that the pump has not been primed, some residual air may remain in the pump. Upon energization of the solenoid coils 16 and 18, the armature piston 38 and secondary piston 62 will move downward. The valve 48 will remain closed such that any air and fluid in chamber 50 will be forced into the discharge passage 66 through passages 78 and 76 to the secondary cylinder 64 or collect in valve chamber 40. While the secondary piston 62 moves from the position shown to a position substantially closing the radial overflow passage 84, the hydraulic fluid and air will be forced into the return tube 74 from which it can be returned to the main oil reservoir.

The secondary piston 62 continues to move downward until the inlet passage 80 is closed at which time fluid is discharged through the outlet valve 92 by the remainder of the piston stroke. The length of the piston stroke past the inlet passage 80 determines the amount of fluid pumped and therefore the pump displacement depends upon the length of secondary piston 62 which within a range of values, can be varied at assembly to control pump displacement.

While the armature piston 38 is moving downward, the valve 30 will open so that incoming hydraulic fluid can fill the space evacuated by the armature piston 38. When the solenoid coils 16 and 18 are deenergized, the return spring 56 will force the armature piston 38 upward such that valve 30 will be closed and control valve 48 will open such that the fluid being displaced by armature piston 38 can flow through the passages 52 and 54 to the pump chamber 50. At the same time, any air in valve chamber 40 will escape to inlet chamber 32 and then exhaust through inlet valve 30 on the next stroke. Since the fluid being displaced by the upward movement of armature piston 38 is greater than the volume of pump chamber 50, the hydraulic fluid will also flow through discharge passage 66 and into passage 88 thereby priming the secondary pump stage for the next pump stroke.

The discharge from the primary pump stage is blocked during discharge of the secondary stage. To prevent stalling of the pump, the fluid from the primary stage is permitted, due to clearance, to flow from chamber 50 to chamber 32 when the discharge pressure is high. In the alternative, a control flow passage can be formed in secondary cylinder 64 between inlet passage 80 and overflow passage 84.

Thus, with cyclic energization of the solenoid coils, a two-stage pumping operation is attained. It is seen that the primary pump stage comprised of armature piston 38 and nonmagnetic cylinder portion 24 displaces substantially more fluid than can be accommodated by the secondary stage pump comprised of secondary piston 62, secondary cylinder 64 and passage 88. The overflow passage 84 permits a portion of this fluid to flow directly through the secondary cylinder 64 thus ensuring good priming of the secondary stage pump. The secondary stage pump can therefore provide a low volume high pressure pump which is useful in various fuel systems utilized in automobiles and/or heater systems.

Obviously, many modifications and variations of the present invention are possible in light of the above teaching. It is therefore to be understood that within the scope of the appended claims, the invention may be practiced otherwise than as specifically described.

The embodiments of the invention in which an exclusive property or privilege is claimed are defined as follows:

1. A two-stage solenoid operated hydraulic pump comprising; a pump cylinder and housing assembly having a nonmagnetic pump cylinder portion; a solenoid coil surrounding a portion of said pump cylinder and housing assembly; spring means disposed in said pump cylinder; an armature piston slidably disposed in said nonmagnetic pump cylinder portion and cooperating therewith to form a first pump means operable to pump fluid through cooperation of said solenoid coil energization and said spring means; an inlet valve for admitting fluid to said first pump means; a delivery passage for delivering fluid from said first pump means; second pump means including a piston secured to and reciprocable with said armature piston, a cylinder means for receiving a portion of said piston when said piston is reciprocated, said cylinder including an inlet passage in fluid communication with said delivery passage, an overflow passage for directing excess fluid delivered by said first pump means from said cylinder means and being disposed to be closed by said piston during the discharge stroke of said second pump means prior to said inlet passage being closed and outlet passage means for delivering fluid from said second pump means; and outlet valve means disposed in fluid communication with said outlet passage means for preventing discharged fluid from reentering said second pump means.

2. A two-stage solenoid operated hydraulic pump comprising; a pump cylinder and housing assembly having a nonmagnetic pump cylinder portion and magnetic portion; a solenoid coil surrounding a portion of said pump cylinder and housing assembly; a return spring in said pump cylinder; an armature piston slidably disposed in said nonmagnetic pump cylinder portion and cooperating therewith to form a first pump means through cooperation of said solenoid coil and said return spring; a nonmagnetic stop means disposed in said assembly in position to abut one end of said armature piston for preventing contact between the armature piston and the magnetic portion of said assembly; an inlet valve for admitting fluid to said first pump means; a delivery passage for delivering fluid from said first pump means; second pump means including a piston secured to and reciprocable with said armature piston, a cylinder means for receiving a portion of said piston when said piston is reciprocated, said cylinder including an inlet passage in fluid communication with said delivery passage, an overflow passage for directing excess fluid delivered by said first pump means from said cylinder means and being disposed to be closed by said piston during the discharge stroke of said second pump means prior to said inlet passage being closed and outlet passage means for delivering fluid from said second pump means; and outlet valve means disposed in fluid communication with said outlet passage means for preventing discharged fluid from reentering said second pump means.

3. A two-stage solenoid operated hydraulic pump comprising; a pump cylinder and housing assembly having a nonmagnetic pump cylinder portion; a solenoid coil surrounding a portion of said pump cylinder and housing assembly; spring means disposed in said pump cylinder; an armature piston slidably disposed in said nonmagnetic pump cylinder portion and cooperating therewith to form a first pump means operable to pump fluid through cooperation of said solenoid coil energization and said spring means, said first pump means being operable to pump fluid during both solenoid action and spring action; an inlet valve for admitting fluid to said first pump means; a delivery passage for delivering fluid from said first pump means; second pump means including a piston secured to and reciprocable with said armature piston, a cylinder means for receiving a portion of said piston when said piston is reciprocated, said cylinder including an inlet passage in fluid communication with said delivery passage, an overflow passage for directing excess fluid delivered by said first pump means from said cylinder means and being disposed to be closed by said piston during the discharge stroke of said second pump means prior to said inlet passage being closed and outlet passage means for delivering fluid from said second pump means; and outlet valve means disposed in fluid communication with said outlet passage means for preventing discharged fluid from reentering said second pump means.

4. A two-stage solenoid operated hydraulic pump comprising; a pump cylinder and housing assembly having a nonmagnetic pump cylinder portion and magnetic portion; a solenoid coil means surrounding a portion of said pump cylinder and housing assembly; a return spring in said pump cylinder; an armature piston slidably disposed in said nonmagnetic pump cylinder portion and cooperating therewith to form a first pump means through cooperation of said solenoid coil and said return spring; a nonmagnetic stop means disposed in said assembly in position to abut one end of said armature piston for preventing contact between the armature piston and the magnetic portion of said assembly; an inlet valve for admitting fluid to said first pump means; a delivery passage for delivering fluid from said first pump means; second pump means including a piston secured to and reciprocable with said armature piston, a cylinder means for receiving a portion of said piston when said piston is reciprocated, said cylinder including an inlet passage in fluid communication with said delivery passage, an overflow passage for directing excess fluid delivered by said first pump means from said cylinder means and being disposed to be closed by said piston during the discharge stroke of said second pump means prior to said inlet passage being closed and outlet passage means for delivering fluid from said second pump means; and outlet valve means disposed in fluid communication with said outlet passage means for preventing discharged fluid from reentering said second pump means, said first pump means being operable to deliver fluid to said second pump means when reciprocated by both said return spring and said solenoid coil means.

* * * * *